US005604571A

United States Patent [19]

Kato et al.

[11] Patent Number: 5,604,571

[45] Date of Patent: Feb. 18, 1997

[54] IMAGE- FORMING APPARATUS HAVING IMAGING X-RAY GENERATION MEANS

[75] Inventors: Masayoshi Kato; Yasuhiro Tomita; Masayoshi Ishikawa, all of Hamamatsu, Japan

[73] Assignee: Hamamatsu Photonics K.K., Hamamatsu, Japan

[21] Appl. No.: 592,714

[22] Filed: Jan. 26, 1996

[30] Foreign Application Priority Data

Jan. 26, 1995 [JP] Japan ..... 7-11016

[51] Int. Cl.[6] ..... G03G 15/00; G03G 15/02

[52] U.S. Cl. ..... 399/162; 250/324; 250/370.09; 361/213; 361/229; 430/902; 399/182; 399/186

[58] Field of Search ..... 355/219, 296; 361/213, 225, 229; 250/370.09, 324, 325, 326; 430/902

[56] References Cited

FOREIGN PATENT DOCUMENTS 3-212658 9/1991 Japan .

OTHER PUBLICATIONS

Funtai No Taidenkkou to Seigyo Ouyou, Published by Gijutsu Jyouhou Kikou (Jul. 15, 1990), pp. 124–129.

*Primary Examiner*—Arthur T. Grimley

*Assistant Examiner*—Sophia S. Chen

*Attorney, Agent, or Firm*—Cushman Darby & Cushman, IP Group of Pillsbury Madison & Sutro LLP

[57] ABSTRACT

An image-forming apparatus which does not unfavorably influence its surrounding environment when in use and is excellent in durability of use and safety is provided. In the image-forming apparatus, a photosensitive layer is disposed on the outer surface of a closed-loop substrate drum, while a charge device, an exposure device, a developing device, a transfer device, a fixing device, and a cleaning device are provided around the substrate drum. The substrate drum is made of a light element. The charge device is constituted by a charging X-ray generation member, which is disposed within the substrate drum and emits an X-ray through the substrate drum and photosensitive layer so as to electrolytically dissociate the air on the surface of the photosensitive layer, and an electric-field application member which guides, by means of an electric field, a gaseous ion formed by this electrolytic dissociation to the surface of the photosensitive layer. The cleaning device is constituted by an erasure X-ray generation member which ionizes the air on the photosensitive layer, in which a coloring fine particle remains, upon irradiation of an X-ray emitted from within the substrate drum through the substrate drum and the photosensitive layer, while generating a carrier within the photosensitive layer.

10 Claims, 3 Drawing Sheets

PRIOR ART

IMAGE- FORMING APPARATUS HAVING IMAGING X-RAY GENERATION MEANS

BACKGROUND OF THE INVENTION

1. Field of the Invention

The present invention relates to an image-forming apparatus such as facsimile machine, copier, or laser printer which, based on input information, forms a visible image on the surface of a flexible recording medium such as paper.

2. Related Background Art

As such an image-forming apparatus, there has conventionally been known an electronic copier using Carlson method such as that shown in FIG. 5. In this electronic copier, an image is formed on the basis of input information as will be explained in the following.

Namely, while a drum 8, which has a semiconductor layer called "photosensitive body" on its outer surface, is rotated, the photosensitive body electrically charged in a dark place by a corona charger 1 utilizing corona discharge. Then, by an exposure device 2, an original to be copied (input information) is irradiated with light so as to form an electrostatic latent image, which has the same pattern as that of the original, on the photosensitive body. Subsequently, by a developing device 3, a coloring fine particle called "toner", which is charged to a polarity opposite to that of the electrostatic latent image, is sprinkled on the photosensitive body. This toner is constituted by resin powder whose particle size is about a few μm to 50 μm. Carbon black or the like is added to the surface or the whole of the powder, and magnetic powder whose particle size is about 0.1 μm to 0.5 μm is dispersed in the resin. Then, by a transfer device 4, the copied image on the photosensitive body formed by the toner is copied on white recording paper by means of electrostatic force. Subsequently, by a fixing device 5, the toner is melted with heat so as to be impregnated between fibers of the recording paper and fixed onto the latter. Thereafter, by a static eliminator 6 constituting a cleaning device, the photosensitive body is destaticized. Also, by a cleaner 7 constituting the cleaning device, the remaining toner is cleaned. Thus, the photosensitive body presumes its initial state. In this manner, the photosensitive body is repeatedly used. Such a series of processing is completed within a few seconds.

SUMMARY OF THE INVENTION

The object of the present invention is to provide an image-forming apparatus which does not unfavorably influence its surrounding environment when in use and is excellent in durability of use and safety.

Namely, the present invention is an image-forming apparatus comprising a substrate which is formed like a closed loop and movable along this closed loop, charge means for electrically charging a photosensitive layer surface which is formed on an outer peripheral surface of this substrate, exposure means for exposing the charged photosensitive layer surface with light to form an electrostatic latent image corresponding to an image to be formed, developing means for attaching a coloring fine particle to the electrostatic latent image, transfer means for transferring the coloring fine particle attached to an area of the electrostatic latent image to a recording medium, fixing means for fixing the coloring fine particle transferred to the recording medium, and cleaning means for cleaning the coloring fine particle remaining on the photosensitive layer surface. The substrate is made of a light element. The charge means is constituted by charging X-ray generation means, which is disposed within the closed loop such that the air on the photosensitive layer surface is electrolytically dissociated by an X-ray transmitted through the substrate and photosensitive layer, and electric-field application means which guides, by means of an electric field, a gaseous ion formed by this electrolytic dissociation to the photosensitive layer surface. The cleaning means is constituted by erasure X-ray generation means which is disposed within the closed loop such that the air on the photosensitive layer in which the coloring fine particle remains is ionized by irradiation of an X-ray transmitted through the substrate and photosensitive layer, while generating a carrier within the photosensitive layer.

In accordance with the present invention configured above, the X-ray emitted from the charging X-ray generation means in the charge means is transmitted through the substrate to generate a gaseous ion on the photosensitive layer. This gaseous ion is guided, by an electric field generated by the electric-field application means, to the photosensitive layer surface, thereby electrically charging the latter.

Also, the X-ray emitted from the erasure X-ray generation means in the cleaning means is transmitted through the substrate to generate a gaseous ion on the photosensitive layer. This gaseous ion neutralizes the coloring fine particle remaining on the photosensitive layer surface. Also, the X-ray emitted from the erasure X-ray generation means generates a carrier within the photosensitive layer. This carrier extinguishes the electrostatic latent image formed in the photosensitive layer.

The present invention will be more fully understood from the detailed description given hereinbelow and the accompanying drawings, which are given by way of illustration only and are not to be considered as limiting the present invention.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will be apparent to those skilled in the art from this detailed description.

DESCRIPTION OF THE PREFERRED EMBODIMENTS

In the conventional image-forming apparatus mentioned above, due to the use of corona discharge in the charger 1 for electrically charging the surface of the photosensitive body and static eliminator 6 for destaticizing the surface of the photosensitive body, there have been the following problems. Namely, when corona discharge is used for electrically charging or destaticizing a photosensitive body, such matters as ozone, NOx, and dust may be generated at the time of corona discharge, thereby oxidizing electrodes, which are peripheral parts of the corona discharger, and deteriorating these peripheral parts. Also, they may cause a fire or the like due to corona discharge. Further, such generation of ozone and NOx is unfavorable for the environment of the earth.

In the following, various embodiments of the image-forming apparatus in accordance with the present invention will be explained with reference to the attached drawings. Among the drawings, the identical elements are referred to by the identical marks, without repeating their explanations.

(First Embodiment)

Figure 1:
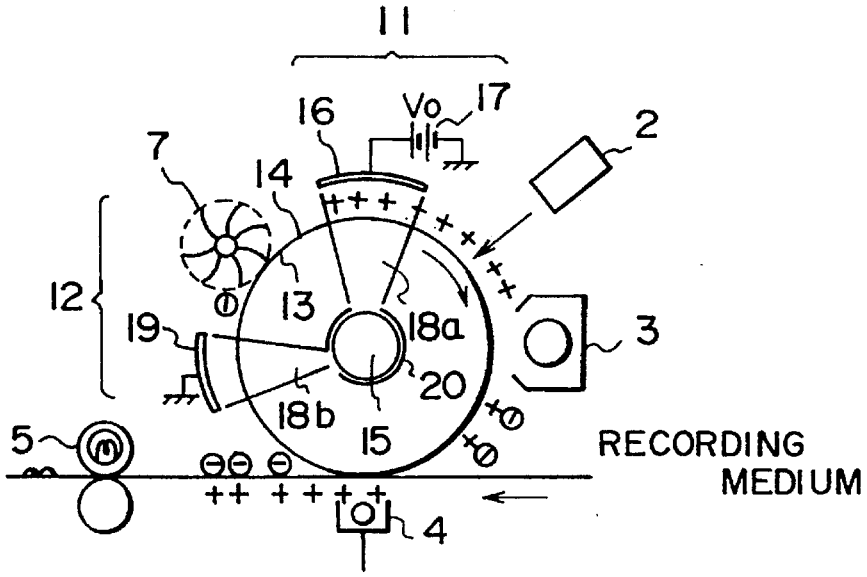
FIG. 1 is a cross-sectional view showing the image-forming apparatus in accordance with an embodiment of the present invention.
Figure 2:
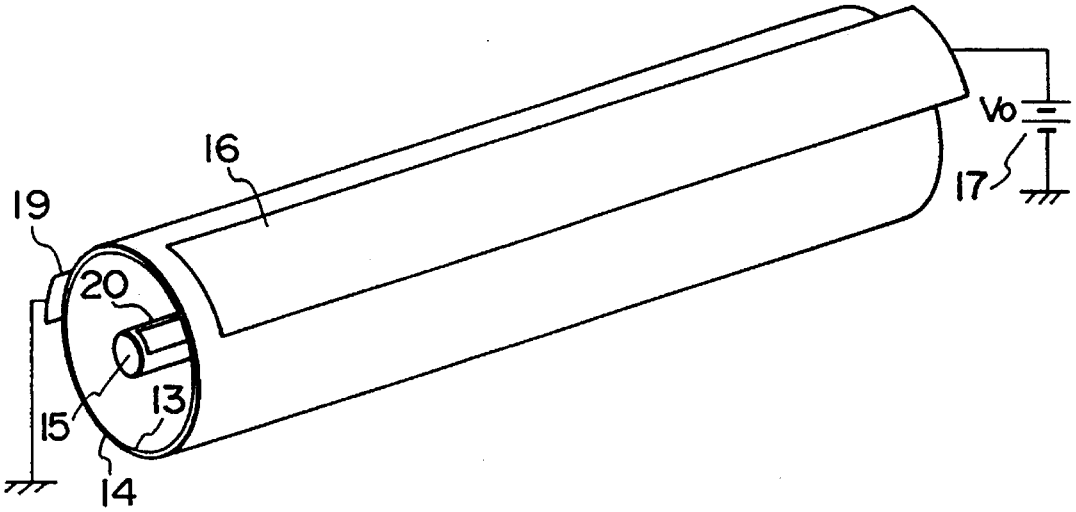
FIG. 2 is a perspective view schematically showing the charge means and cleaning means in the image-forming apparatus in accordance with this embodiment.
Figure 5:
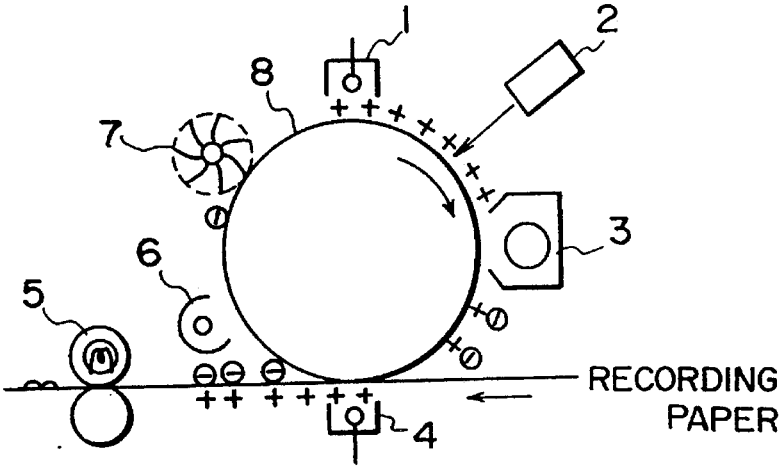
FIG. 5 is a view showing a basic configuration of the conventional image-forming apparatus.

FIG. 1 shows the basic configuration of the image-forming apparatus in accordance with this embodiment, in which the parts identical to those of FIG. 5 are referred to by the identical marks. Also, FIG. 2 is a perspective view showing charge means 11 and cleaning means 12 which are characterizing parts of this image-forming apparatus. While being characterized by the charge means 11 and cleaning means 12, the image-forming apparatus in accordance with this embodiment uses the exposure device 2, developing device 3, transfer device 4, and fixing device 5 which are similar to those of the conventional apparatus shown in FIG. 5. Also, as a recording medium for forming an image, a flexible material such as paper is used. Further, when control means for irradiating light is altered in the exposure device 2, the image-forming apparatus can be used as such machines as copier, facsimile machine, and laser printer. For example, when the exposure device 2 is provided with a read-out mechanism for reading out an image from an original, while the read-out mechanism is enabled to emit an optical signal through an optical system such as lens and mirror, the image-forming apparatus can be used as a copier. Alternatively, when the exposure device 2 is connected to a telephone line by way of a modem so as to irradiate light corresponding to an electric signal output from the modem, the image-forming apparatus can be used as a facsimile machine. Also, when the exposure device 2 is enabled to irradiate a laser beam corresponding to an external electric signal, the image-forming apparatus can be used as a laser printer.

In FIG. 1, a substrate drum 13 is made of a light element such as beryllium or carbon and in a cylindrical shape forming a closed loop. This substrate drum 13 is rotated around the axis of its cylinder. Due to this rotation, the substrate drum 13 moves along the closed loop. On the outer surface of the closed loop of the substrate drum 13, a photosensitive layer 14 made of a semiconductor layer is formed. The charge means 11 is used for electrically charging the surface of this photosensitive layer 14 and comprises an X-ray tube 15 disposed within the above-mentioned closed loop, an external fixed charging electrode 16, and a power supply 17. The X-ray tube 15 is surrounded by an X-ray shielding plate 20 which divides the X-rays emitted from the X-ray tube 15 into a first X-ray 18*a* directed toward the charge means 11 and a second X-ray 18*b* directed toward the cleaning means 12. Since the substrate drum 13 is made of a light element, the X-rays 18*a* and 18*b* emitted from the X-ray tube 15 are efficiently transmitted through the substrate drum 13 and photosensitive layer 14. The fixed charging electrode 16 is made of a metal plate and disposed outside of the closed loop of the photosensitive layer 14 so as to face the X-ray tube 15 by way of the substrate drum 13 and photosensitive layer 14. To this fixed charging electrode 16, voltage $V_0$ is applied from the power supply 17. The fixed charging electrode 16 and the power supply 17 constitute electric-field application means, whereby an electric field directed from the fixed charging electrode 16 to the surface of the photosensitive layer 14 is formed as the voltage is applied to the fixed charging electrode 16.

The X-ray tube 15 constituting charging X-ray generation means also constitutes erasure X-ray generation means in a static eliminator portion which constitutes the cleaning means 12. In this cleaning means 12, a fixed erasure electrode 19 is disposed outside of the closed loop so as to face the X-ray tube 15 by way of the substrate drum 13 and photosensitive layer 14. This fixed erasure electrode 19 is grounded. Also, a brush cleaner 7 is disposed at a position which is close to the fixed erasure electrode 19 in the direction of the rotation of the substrate drum 13.

The above-mentioned X-ray tube 15 constituting the charging and erasure X-ray generation means is disposed along the central axis of the cylindrical substrate drum 13. In order to uniformly charge and destaticize the surface of the photosensitive layer 14, it is desirable for the X-ray tube 15 to be constituted by a long-type X-ray tube as in this embodiment rather than by a plurality of short X-ray tubes arranged in a row along the central axis of the substrate drum 13. This X-ray tube 15 generates X-rays within the energy range of 1 to 20 keV.

In the following, the charging mechanism in the image-forming apparatus configured above will be explained with reference to FIG. 3A. In this drawing, the parts identical to those of FIGS. 1 and 2 are referred to by the identical marks, without repeating their explanations.

Figure 3A:
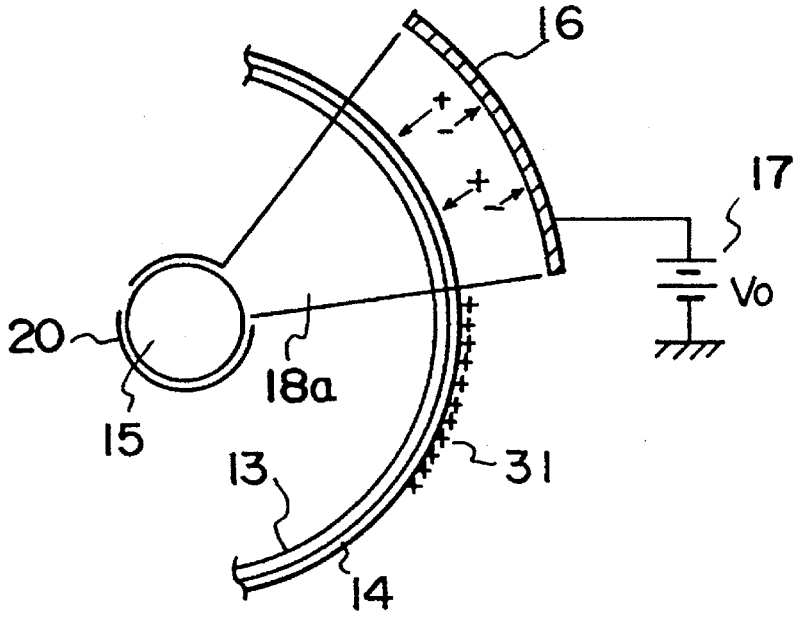
FIGS. 3A and 3B are partially enlarged cross-sectional views respectively showing the charging and erasure mechanisms in the image-forming apparatus in accordance with this embodiment.

As shown in FIG. 3A, as being irradiated with the first X-ray 18*a* from the X-ray tube 15, the air between the fixed charging electrode 16 in the charge means 11 and the photosensitive layer 14 is electrolytically dissociated, thereby generating gaseous ions. Among these gaseous ions, those charged to positive polarity (+) are guided to the surface of the photosensitive layer 14 by the electric field generated by the electric-field application means. Accordingly, the surface of the photosensitive layer 14 is charged with a positive electric charge 31. Since the long-type X-ray tube is used as the X-ray tube 15 as mentioned above, the air on the surface of the photosensitive layer 14 is uniformly irradiated with the X-rays, thereby uniformly generating gaseous ions in the air held between the fixed charging electrode 16 and the photosensitive layer 14. Therefore, the surface of the photosensitive layer 14 is uniformly charged with the positive electric charge (+).

Also, the electric charge on the surface of the photosensitive layer 14 can be set to a desirable polarity depending on the polarity of the voltage applied to the fixed charging electrode 16. Accordingly, the polarity of the charge on the surface of the photosensitive layer 14 can be arbitrarily selected with reference to the polarity (+) or (−) of the toner used. Also, as the voltage value applied to the fixed charging electrode 16 is selected, the surface electric potential of the photosensitive layer 14 can be set to a desirable charge potential. Accordingly, as this voltage value is selected, the electric charge amount Q of the charged gaseous ions on the surface of the photosensitive layer 14 can be freely controlled. Also, since the charge potential of the photosensitive layer 14 can be strictly controlled, the quality of the formed image can be improved. The surface of the photosensitive layer 14 is electrically charged by such a charging mechanism.

Figure 3B:
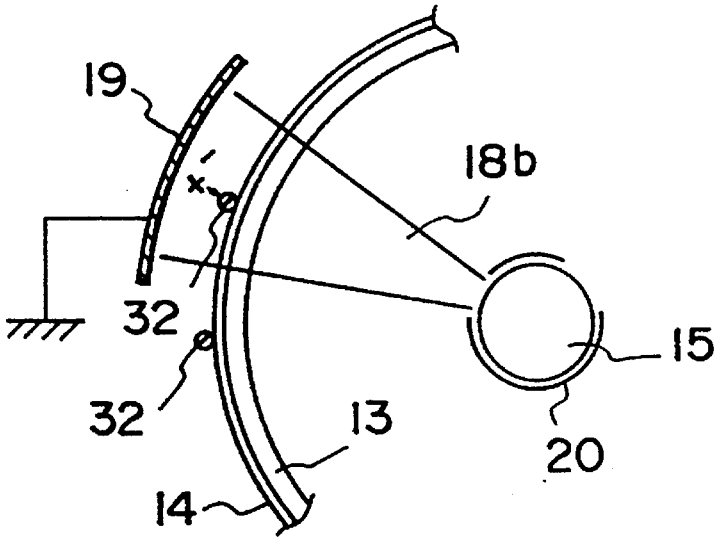

Next, the erasure mechanism for the latent electric charge in the image-forming apparatus will be explained with reference to FIG. 3B.

The air on the photosensitive layer 14 rotated from the fixing device 15 to reach the cleaning means 12 is irradiated with the second X-ray **18*b* from the X-ray tube 15 transmitted through the substrate drum 13 and photosensitive layer 14. Upon irradiation with this X-ray 18*b*, the air on the photosensitive layer 14 is electrolytically dissociated, thereby generating gaseous ions. Among thus generated gaseous ions, those charged to positive polarity neutralize the electric charge of a toner 32 which has been charged to negative polarity and remains on the surface of the photosensitive layer 14. Simultaneously, the X-ray 18*b* emitted from the X-ray tube 15 generates a carrier within the photosensitive layer 14, thereby neutralizing and extinguishing the latent image formed in the photosensitive layer 14. The neutralized toner remaining on the photosensitive layer 14 is removed by the brush cleaner 7, whereby the surface of the photosensitive layer 14 is cleaned. The surface of the photosensitive layer 14** is destaticized and cleaned by such an erasure mechanism.

In the following, the action of the image-forming apparatus in accordance with this embodiment will be explained.

First, in FIG. 1, while the substrate drum 13 is rotated, the charge means 11 is actuated such that the surface of the photosensitive layer 14 disposed on the outer surface of the substrate drum 13 is uniformly electrically charged by the above-mentioned charging mechanism. When thus charged photosensitive layer 14 is moved to the position of the exposure device 2 as the substrate drum 13 is rotated, electrostatic latent images corresponding to images to be formed are sequentially formed on its surface upon exposure to the light emitted from the exposure device 2. Then, when the photosensitive layer 14 is moved to the developing device 3, a toner, which is a coloring fine particle charged to a polarity different from that of the electrostatic latent image, is attached to the area of such an electrostatic latent image. While a black toner is usually used therefor, it may be in other colors as well. When the photosensitive layer 14 is further moved to the position of the transfer device 4, a recording medium is supplied, in synchronization with this movement, between the substrate drum 13 and the transfer device 4, whereby the toner on the photosensitive layer 14 is transferred to the recording medium due to the electrostatic force from the transfer device 4. After this transfer, the recording medium is moved to the position of the fixing device 5, where the toner is fixed to the recording medium upon heating at the fixing device 5 so as to form a desirable image on the recording medium. On the other hand, while there remains a toner in the photosensitive layer 14 after the transfer of the toner, such a toner is securely destaticized and cleaned by the cleaning means 12 as mentioned above, whereby the photosensitive layer 14 resumes its initial state. Then, after the photosensitive layer 14 is electrically charged by the charge means 11, the steps of exposure, development, transfer, and cleaning are repeated so as to form an image.

(Second Embodiment)

Figure 4:
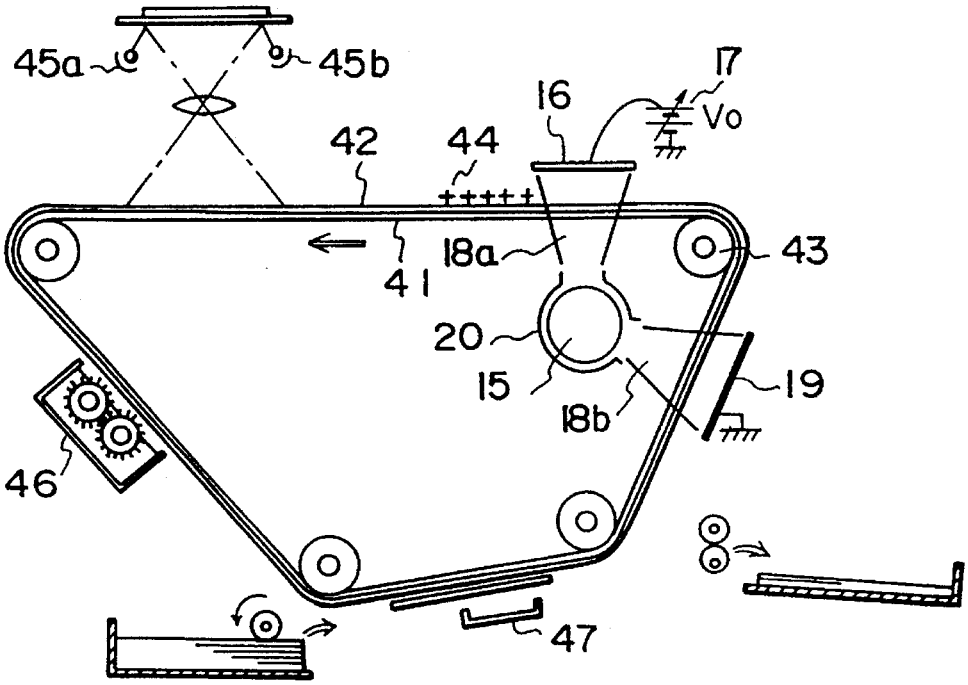
FIG. 4 is a cross-sectional view showing the image-forming apparatus in accordance with a modified example of this embodiment.

While the cylindrical substrate drum 13 is used as a substrate for moving the photosensitive layer 14 in the image-forming apparatus in accordance with the first embodiment explained in the foregoing, the substrate should not be restricted thereto. For example, as shown in FIG. 4, a sheet film belt 41 made of a light element forming a closed loop may be used as the substrate. In this case, a photosensitive body 42 made of an organic optical semiconductor is formed on the surface of the sheet film belt 41 outside of closed loop, while a driving roller 43 moves the belt 41 along the closed loop. As in the above-mentioned embodiment, the X-ray tube 15 constituting the X-ray generation means and X-ray erasure means is disposed within the closed loop. Also, the fixed charging electrode 16 and the fixed erasure electrode 19 are disposed outside of the closed loop so as to face the X-ray tube 15 by way of the belt 41 and photosensitive body 42, thereby respectively constituting the charge means 11 and the cleaning means 12. In such a configuration, due to the first X-ray **18*a* emitted from the X-ray tube 15, the surface of the photosensitive body 42 is charged with an electric charge 44 as well. Also, due to the second X-ray tube 18*b* emitted from the X-ray tube 15, the electric charge of the toner remaining on the surface of the photosensitive body 42 is neutralized while the electrostatic latent image remaining in the photosensitive body 42** is extinguished. Thus, in such a configuration, the effects similar to those of the first embodiment can be attained.

Here, flash lamps **45*a* and 45*b* constitute an exposure device, while a developing device 46 sprinkles the toner on the electrostatic latent image formed by this exposure device. The resulting image is transferred to a recording medium by a transfer device 47**.

In the present invention, as explained in the foregoing, the X-ray emitted from the charging X-ray generation means in non-contact charge means is transmitted through the substrate to generate a gaseous ion on the photosensitive layer. This gaseous ion is guided, by an electric field generated by the electric-field application means, to the photosensitive layer surface, thereby electrically charging the latter. Also, the X-ray emitted by the erasure X-ray generation means in the cleaning means is transmitted through the substrate to generate a gaseous ion on the photosensitive layer. This gaseous ion neutralizes the coloring fine particle remaining on the photosensitive layer surface. Also, this X-ray emitted from the erasure X-ray generation means generates a carrier within the photosensitive layer. This carrier extinguishes, in a non-contact manner, the electrostatic latent image formed in the photosensitive layer.

Therefore, the charging and destaticizing of the photosensitive layer can be effected without using the conventional corona discharge and, accordingly, such matters as ozone, NOx, and dust are not generated by the image-forming apparatus in accordance with the present invention. Thus, it can overcome the conventional problems that electrodes, which are peripheral parts of the charge means and static eliminator means, may be oxidized to deteriorate the peripheral parts. Also, for example, there is no possibility of a fire being generated due to corona discharge. Further, an image-forming apparatus which is preferable for the environment of the earth can be realized.

Moreover, since the X-ray generation means is disposed within the closed loop of the substrate, there is no need for providing corona discharge means which has conventionally had to be disposed outside of the closed loop. Accordingly, an image-forming apparatus having a small size can be realized.

From the invention thus described, it will be obvious that the invention may be varied in many ways. Such variations are not to be regarded as a departure from the spirit and scope of the invention, and all such modifications as would be obvious to one skilled in the art are intended for inclusion within the scope of the following claims.

The basic Japanese Application No. 011016/1995 (7-011016) filed on Jan. 26, 1995, is hereby incorporated by reference.

What is claimed is:

1. An image-forming apparatus for forming an image on a recording medium, comprising:

a substrate which is formed like a closed loop and movable along this closed loop, said substrate being made of a light element;

charge means for electrically charging a surface of a photosensitive layer which is formed on an outer peripheral surface of said substrate, said charge means having charging X-ray generation means, which is disposed within said closed loop such that air on the surface of said photosensitive layer is electrolytically dissociated by an X-ray transmitted through said substrate and said photosensitive layer, and electric-field application means which guides, by means of an electric field, a gaseous ion formed by the electrolytic dissociation to the surface of said photosensitive layer;

exposure means for exposing the charged surface of said photosensitive layer with light to form an electrostatic latent image corresponding to said image to be formed;

developing means for attaching a coloring fine particle to an area of said electrostatic latent image;

transfer means for transferring said coloring fine particle attached to the area of said electrostatic latent image to said recording medium;

fixing means for fixing said coloring fine particle transferred to said recording medium; and cleaning means for cleaning said coloring fine particle remaining on the surface of said photosensitive layer, said cleaning means having erasure X-ray generation means which is disposed within said closed loop such that air on said photosensitive layer in which said coloring fine particle remains is ionized by irradiation of an X-ray transmitted through said substrate and said photosensitive layer, and generates a carrier within said photosensitive layer.

2. An image-forming apparatus according to claim 1, wherein said charging X-ray generation means and said erasure X-ray generation means are commonly constituted by single X-ray generation means.

3. An image-forming apparatus according to claim 1, wherein said electric-field application means comprises an electrode, which is disposed outside of said closed loop and faces at least one of said charging X-ray generation means and said erasure X-ray generation means by way of said substrate and said photosensitive layer, and a power supply which applies a voltage to said electrode.

4. An image-forming apparatus according to claim 1, wherein said substrate comprises a cylindrical drum.

5. An image-forming apparatus according to claim 1, wherein said substrate comprises a belt in a closed loop.

6. An image-forming apparatus according to claim 1, wherein said substrate is made of beryllium.

7. An image-forming apparatus according to claim 1, wherein said substrate is made of carbon.

8. An image-forming apparatus according to claim 1, wherein said image-forming apparatus is used as a copier.

9. An image-forming apparatus according to claim 1, wherein said image-forming apparatus is used as a facsimile machine.

10. An image-forming apparatus according to claim 1, wherein said image-forming apparatus is used as a laser printer.

* * * * *